US010735871B2

(12) United States Patent
Webster et al.

(10) Patent No.: US 10,735,871 B2
(45) Date of Patent: Aug. 4, 2020

(54) ANTENNA SYSTEM WITH ADAPTIVE CONFIGURATION FOR HEARING ASSISTANCE DEVICE

(71) Applicant: Starkey Laboratories, Inc., Eden Prairie, MN (US)

(72) Inventors: Trevor Webster, Minneapolis, MN (US); Sasidhar Vajha, Liague City, TX (US); Jeffrey Paul Solum, Greenwood, MN (US); Gregory John Haubrich, Champlin, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 22 days.

(21) Appl. No.: 15/071,107

(22) Filed: Mar. 15, 2016

(65) Prior Publication Data

US 2017/0272873 A1 Sep. 21, 2017

(51) Int. Cl.
*H04R 25/00* (2006.01)

(52) U.S. Cl.
CPC ..... *H04R 25/554* (2013.01); *H04R 25/55* (2013.01); *H04R 2225/51* (2013.01)

(58) Field of Classification Search
CPC ..... H04R 25/554; H04R 2225/51
USPC ..... 381/23.1, 315, 60; 455/552.1, 569.1
See application file for complete search history.

(56) References Cited

U.S. PATENT DOCUMENTS 1,792,523 A 2/1931 Zonel
5,905,473 A 5/1999 Taenzer
6,380,896 B1 4/2002 Berger et al.
7,113,748 B2 9/2006 Shapira et al.
7,446,720 B2 11/2008 Victorian et al.
7,529,565 B2 * 5/2009 Hilpisch ..... H04R 25/554 381/312
7,593,538 B2 9/2009 Polinske
8,036,405 B2 10/2011 Ludvigsen et al.
8,121,662 B2 2/2012 Martin et al.
8,180,080 B2 5/2012 Polinske
(Continued)

FOREIGN PATENT DOCUMENTS

DE 20114461 U1 10/2001
EP 2498514 B1 1/2014
(Continued)

OTHER PUBLICATIONS

Chang, Kai. (2005). Encyclopedia of RF and Microwave Engineering, vols. 1-6. pp. 225-300. John Wiley & Sons. Retrieved from (Year: 2005).*
(Continued)

*Primary Examiner* — Phylesha Dabney
(74) *Attorney, Agent, or Firm* — Schwegman Lundberg & Woessner, P.A.

(57) ABSTRACT

A hearing assistance device such as a hearing aid includes an antenna system that has an adaptive antenna configuration that can be dynamically optimized for communicating with one or more other devices at different locations. The hearing assistance device determines an approximately optimal antenna configuration and adjusts the antenna configuration to that approximately optimal antenna configuration using one or more switches coupled between the antenna system and a communication circuit of the hearing assistance device.

23 Claims, 7 Drawing Sheets

(56) References Cited

U.S. PATENT DOCUMENTS

| | | | | |
|---|---|---|---|---|
| 8,565,457 | B2 | 10/2013 | Polinske et al. | |
| 8,699,733 | B2 | 4/2014 | Polinske et al. | |
| 8,902,772 | B2 | 12/2014 | Lenaerts | |
| 8,923,789 | B2 * | 12/2014 | Bendsen | H03F 1/56 455/193.1 |
| 8,958,588 | B2 | 2/2015 | Müller | |
| 9,191,757 | B2 * | 11/2015 | Bauman | H04R 25/554 |
| 9,432,780 | B2 * | 8/2016 | Solum | H04R 25/554 |
| 9,497,553 | B2 * | 11/2016 | Solum | H04R 25/554 |
| 9,661,427 | B2 * | 5/2017 | Bauman | H04R 25/554 |
| 2003/0092402 | A1 | 5/2003 | Shapira et al. | |
| 2003/0179137 | A1 | 9/2003 | White et al. | |
| 2010/0054512 | A1 | 3/2010 | Solum | |
| 2010/0120466 | A1 | 5/2010 | Li | |
| 2010/0302123 | A1 | 12/2010 | Knudsen et al. | |
| 2011/0019830 | A1 | 1/2011 | Leibman et al. | |
| 2011/0075870 | A1 * | 3/2011 | Solum | H04R 25/554 381/315 |
| 2012/0002830 | A1 * | 1/2012 | Solum | H04R 25/554 381/315 |
| 2012/0202560 | A1 | 8/2012 | Donaldson | |
| 2013/0029624 | A1 * | 1/2013 | Bendsen | H03F 1/56 455/234.1 |
| 2014/0010392 | A1 | 1/2014 | Kvist | |
| 2014/0010393 | A1 | 1/2014 | Kvist | |
| 2014/0270211 | A1 * | 9/2014 | Solum | H04R 25/554 381/60 |
| 2015/0016645 | A1 * | 1/2015 | Bauman | H04R 25/554 381/315 |
| 2015/0030190 | A1 | 1/2015 | Rabel et al. | |
| 2015/0124976 | A1 | 5/2015 | Pedersen et al. | |
| 2015/0131832 | A1 | 5/2015 | Jeppesen | |
| 2015/0181374 | A1 | 6/2015 | Tsuda | |
| 2015/0304783 | A1 * | 10/2015 | Haubrich | H04R 25/554 381/315 |
| 2016/0037270 | A1 * | 2/2016 | Polinske | H04R 25/554 381/315 |
| 2016/0049074 | A1 * | 2/2016 | Shennib | G08C 17/02 381/23.1 |
| 2016/0057550 | A1 * | 2/2016 | Shennib | H04R 25/554 381/315 |
| 2016/0173998 | A1 * | 6/2016 | Bauman | H04R 25/554 381/315 |
| 2017/0127191 | A1 * | 5/2017 | Solum | H04R 25/305 |
| 2017/0272872 | A1 | 9/2017 | Bauman et al. | |

FOREIGN PATENT DOCUMENTS

| | | | |
|---|---|---|---|
| EP | 2838210 | A1 | 2/2015 |
| EP | 2871859 | A1 | 5/2015 |
| JP | 57202146 | A | 12/1982 |
| JP | 2010199661 | A | 9/2010 |

OTHER PUBLICATIONS

Bensky, Alan (2016). Wireless Positioning Technologies and Applications (2nd edition), Chapter 7. section 7.3—Finding Direction from Antenna Patterns. Artech House. Retrieved from hpps//:app.knovel.com/hotlink/pdf/id:kt011M8EO1/wireless-positioning/finding-direction-from (Year: 2016).*

Krieger, Kim, "Spectrum-Stretching Tunable Antennas to the Rescue", http://spectrum.ieee.org/telecom/wireless/spectrumstretching-tunable-antennas-to-the-rescue, (Feb. 22, 2013), 3 pgs.

"U.S. Appl. No. 15/071,030, Non Final Office Action dated Sep. 26, 2017", 11 pgs.

"European Application Serial No. 17161171.8, Extended European Search Report dated Jul. 11, 2017", 8 pgs.

"European Application Serial No. 17161183.3, Extended European Search Report dated Jun. 27, 2017", 11 pgs.

"U.S. Appl. No. 15/071,030, Response filed Dec. 22, 2017 to Non Final Office Action dated Sep. 26, 2017", 9 pgs.

"U.S. Appl. No. 15/071,030,Advisory Action dated Jun. 21, 2018",2 pgs.

"U.S. Appl. No. 15/071,030, Final Office Action dated Mar. 19, 2018", 12 pgs.

"U.S. Appl. No. 15/071,030, Response filed May 21, 2018 to Final Office Action dated Mar. 19, 2018", 10 pgs.

"U.S. Appl. No. 15/071,030, Non Final Office Action dated Aug. 1, 2018", 19 pgs.

"U.S. Appl. No. 15/071,030, Response filed Nov. 1, 2018 to Non Final Office Action dated Aug. 1, 2018", 9 pgs.

"European Application Serial No. 17161183.3, Summons to Attend Oral Proceedings dated Oct. 17, 2018", 11 pgs.

* cited by examiner

ANTENNA SYSTEM WITH ADAPTIVE CONFIGURATION FOR HEARING ASSISTANCE DEVICE

CROSS REFERENCE TO RELATED APPLICATIONS

The present application is related to U.S. patent application Ser. No. 15/071,030, entitled "ADJUSTABLE ELLIPTICAL POLARIZATION PHASING AND AMPLITUDE WEIGHTING FOR A HEARING INSTRUMENT", filed on Mar. 15, 2016, which is incorporated by reference herein in its entirety.

TECHNICAL FIELD

This document relates generally to hearing assistance systems and more particularly to a hearing assistance device that includes an antenna system with adaptive configuration for wireless communication with other devices.

BACKGROUND

Hearing assistance devices may be configured to be worn by a user and communicate with other devices via wireless links. Examples of hearing assistance devices include hearing aids that are used to assist patients suffering hearing loss by transmitting amplified sounds to ear canals. The sounds may be detected from a patient's environment using the microphone in a hearing aid and/or received from a streaming device via a wireless link. The hearing aids may each include an antenna for wireless communication with each other and/or other devices. In one example, a hearing aid is worn in and/or around a patient's ear. The hearing aid wirelessly communicates with other devices at various locations relative to the hearing aid, such as another hearing aid worn on the patient's opposite ear, a hand-held or body worn hearing aid accessory device, a hearing aid programmer, and devices that stream audio to the hearing aid. Patients generally prefer that their hearing aids are minimally visible or invisible, do not interfere with their daily activities, and easy to maintain. Thus, the hearing aid needs an antenna system allowing for reliable signal transmission to and from various directions without significant impacting the size of the hearing aid.

SUMMARY

A hearing assistance device such as a hearing aid includes an antenna system that has an adaptive antenna configuration that can be dynamically optimized for communicating with one or more other devices at different locations. The hearing assistance device determines an approximately optimal antenna configuration and adjusts the antenna configuration to that approximately optimal antenna configuration using one or more switches coupled between the antenna system and a communication circuit of the hearing assistance device.

In one embodiment, a hearing assistance device is configured to be worn by a wearer and capable of wireless communication with a plurality of devices. The hearing assistance device includes a communication circuit, an antenna system, and a control circuit. The communication circuit transmits signals to and receive signals from each device of the plurality of devices. The antenna system has an antenna configuration and includes one or more antennas and a switching circuit that adjusts the antenna configuration by controlling one or more electrical connections between the one or more antennas and the communication circuit. The control circuit includes an antenna optimizer that determines an approximately optimal antenna configuration for communicating with a target device of the plurality of devices based on a location of the target device relative to the hearing assistance device when the location of the target device is known and controls the switching circuit according to the approximately optimal antenna configuration.

In one embodiment, a method for operating a hearing assistance device for wireless communication is provided. The hearing assistance device communicates with a target device using an antenna system having an adjustable antenna configuration. An approximately optimal antenna configuration is determined for communicating with the target device based on a location of the target device relative to the hearing assistance device when the location of the target device is indicated by a type of the target device. The antenna configuration is adjusted to the approximately optimal antenna configuration by controlling one or more switches each connected between the antenna system and a communication circuit of the hearing assistance device.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
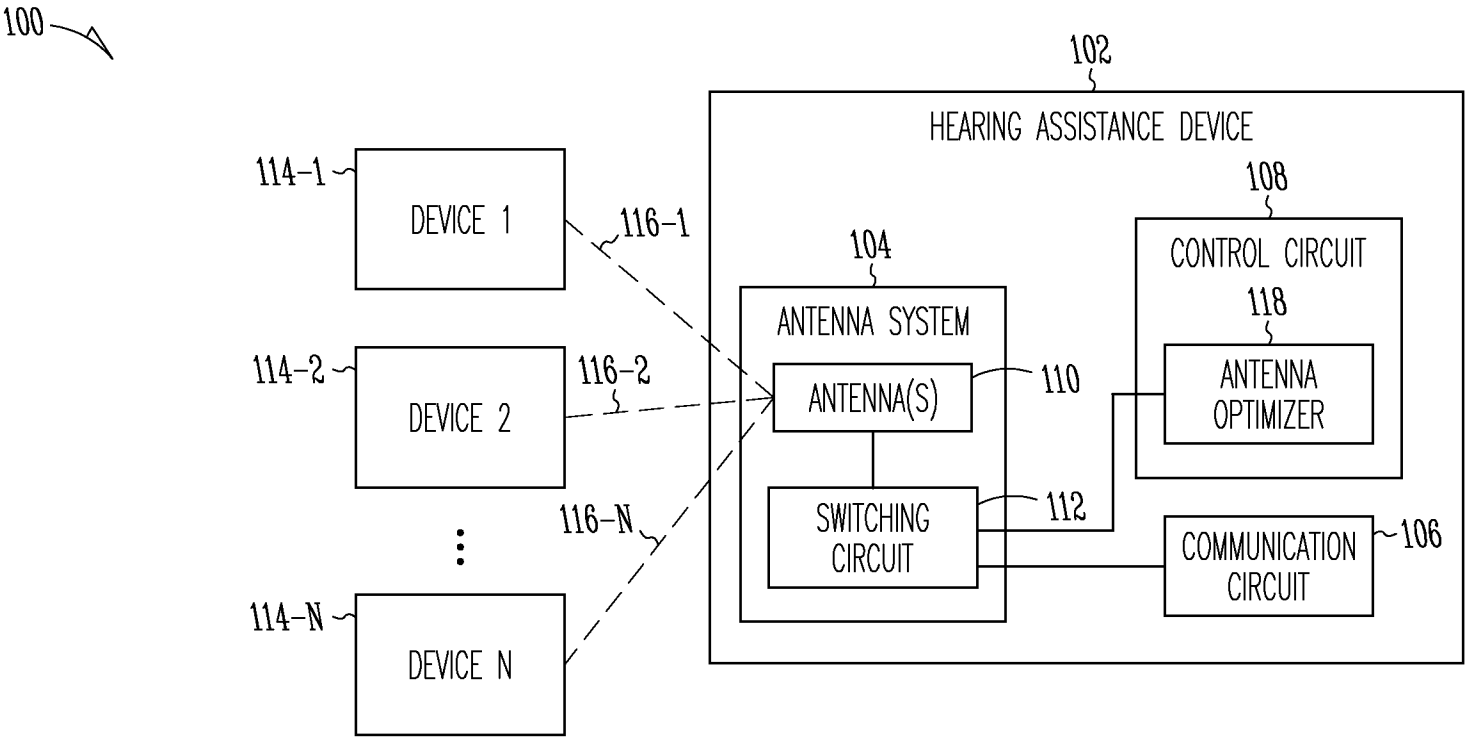
FIG. 1 is a block diagram illustrating an embodiment of a hearing assistance system including a hearing assistance device capable of wireless communication with a plurality of devices.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a hearing assistance device with an antenna system that has an adaptive configuration that can be dynamically optimized for communicating with one or more other devices at different locations. Wireless communications are performed between a pair of right and left hearing assistance devices (referred to as ear-to-ear communication) and between a hearing assistance device and another type of device such as a body worn accessory device. The present subject matter uses switches, such as radio-frequency (RF) micro-electro-mechanical systems (MEMS) switches, to control configuration hence radiation pattern of the antenna system to approximately optimize performance of wireless communication for multiple use cases in which signals are transmitted to, and received from, different directions.

The link margin for wireless communication between a pair of left and right hearing assistance devices, such as hearing aids, when being worn by a wearer is limited by factors including absorption of RF energy by the wearer's body, limited capacity of the power source, and limited size an antenna. This link margin can be improved by modifying location, radiation pattern, and polarization of the antenna to provide a desirable directionality. However, the hearing assistance device may also need to communicate with devices such as accessories and programmers located at various locations that may change during use of the hearing assistance device. Thus, a pseudo omnidirectional radiation pattern is used in some examples, but does not address the issue of small link margin due to power and size limitations.

The present subject matter provides an hearing assistance device such as a hearing aid with an adaptive antenna system that can be electrically switched to alter its location, radiation pattern, and/or polarization for whenever desired for various use cases including ear-to-ear communication with another hearing assistance device, communication between the hearing assistance device and a body-worn accessory, communication between the hearing assistance device and an off-body accessory, remote control, or programmer, etc. For the purpose of altering its location, radiation pattern, and/or polarization by electrical switching, the antenna system can include an antenna with multiple elements, multiple antennas, or multiple antennas each having multiple elements, so that one or more elements or antenna can be switched "on" or "off", for example.

Due to the power and size limitations for the hearing assistance device such as hearing aid, a low-power, high-speed RF switching technique using miniature devices is required for altering the location, radiation pattern, and/or polarization of the antenna in the hearing assistance device. One example of such low-power, high-speed RF switching technique uses one or more MEMS switches. In various embodiments, one or more low-power switches such as one or more MEMS switches are used to alter characteristics of the antenna system that includes multiple antennas and/or multiple antenna elements.

Optimizing performance of the antenna system of the hearing assistance device for ear-to-ear wireless communications does not necessarily optimize the performance of the antenna system for off-body wireless communications with accessories. In some embodiments, performance of the antenna system can be optimized based on known types of devices with which the hearing assistance device wirelessly communicates (both initiating communications, and in-session communications) and very likely, known orientations and proximity to the human body. Using known use case information (such as information on ear-to-ear communication) can allow the antenna system to be optimized when communicating to a known device, or multiple known devices. In some embodiments, an initial optimization of the antenna system can be performed based on known use case information, and then further optimization can be performed on a dynamic basis throughout the wireless communications session, for example based on optimization of parameters indicative of quality of the wireless communication.

In various embodiments, the configuration and hence the radiation pattern of the antenna system are adaptively changed using the one or more low-power switches to better suit specific use cases such as on head (e.g., ear-to-ear communication) communication and off-head communication (e.g., communication with a body worn device). For example, in a pico-net, such adaptive change can be applied to configure the radiation pattern of the transmit mode, polarization, impedance, phase, etc., of the antenna system to optimize the signal strength at the intended receiving device. In various embodiments, a predetermined optimization of the antenna system can be performed for ear-to-ear communication between hearing assistance devices, where the relative direction and orientation of the target device (intended transceiver) is known, or an adaptive optimization of the antenna system can be performed when the relative location and orientation of the target device (intended transceiver) is not known. In various embodiments, the configuration and hence radiation pattern of the antenna system are changed using one or more switches providing for fast switching with very low loss and a high dynamic range, such as one or more MEMS switches.

In this document, an "antenna system" may include one or more antennas placed in a hearing assistance device and coupled to a communication circuit (e.g., a transceiver) to allow the hearing assistance device to perform wireless communication with another device. The physical configuration and hence radiation pattern of the antenna system is adaptively changed by switching, which can include electrically connecting an antenna or an element of an antenna to the communication circuit (i.e., "switching in"), electrically disconnecting an antenna or an element of an antenna from the communication circuit (i.e., "switching out"), and electrically connecting and disconnecting between antennas or elements of an antenna. An antenna element (or "element") includes a portion of an antenna that affects the radiation pattern of the antenna when being electrically coupled to the communication circuit. In various embodiments, the switching can include disconnecting an antenna (or antenna element) from the communication circuit and connecting another antenna (or antenna element) to the communication circuit, or keeping a primary antenna connected to the communication circuit while switching in or out another antenna (or antenna element) in series with or parallel to the primary antenna (or antenna element). In various embodiments, the antenna system can include an antenna array if the hearing assistance device can accommodate its size.

FIG. 1 is a block diagram illustrating an embodiment of a hearing assistance system 100. System 100 includes a hearing assistance device 102 that is capable of wireless communication with a plurality of devices 114 via communication links 116. Hearing assistance device 102 includes an antenna system 104, a communication circuit 106, and a control circuit 108. Antenna system 104 has an adjustable antenna configuration and includes one or more antennas 110 and a switching circuit 112 connected between antenna(s) 110 and communication circuit 106. Switching circuit 112 adjusts the antenna configuration by controlling one or more electrical connections between antenna(s) 110 and communication circuit 106. Communication circuit 106 transmits signals to and receive signals from each device of devices 114. Control circuit 108 control the operations of hearing assistance device 102 and includes an antenna optimizer 118 that is coupled to switching circuit 112. Antenna optimizer 118 determines an approximately optimal antenna configuration for communicating with a target device of devices 114 based on a location of the target device relative to hearing assistance device 102 and controls switching circuit 112 according to the approximately optimal antenna configuration.

While FIG. 1 shows device 114-1 communicatively coupled to hearing assistance device 102 via communications link 116-1, device 114-2 communicatively coupled to hearing assistance device 102 via communications link 116-2, . . . and device 114-N communicatively coupled to hearing assistance device 102 via communications link 116-N, hearing assistance device 102 may communicate with any one or more devices with the antenna configuration of antenna system 104 approximately optimized according to the present subject matter. Examples of devices 114 include other hearing assistance devices, accessory devices, programming devices, remote controllers, and audio streaming devices.

In various embodiments, one or more antennas 110 of antenna system 104 can include any one or more types of antenna suitable for using in a hearing assistance device such as a hearing aid. In various embodiments, antenna system 104 has one or more characteristics controllable by adjusting the antenna configuration of antenna system 104. Examples of such one or more controllable characteristics include electrical length, number of active elements (geometry), phasing of one or more antenna elements, location of antenna elements (e.g., farther from, closer to, or on the human head), impedance of the antenna(s) (and controlled phase and amplitude fed to multiple elements), similarity between antennas of two systems (to improve coupling between the two system for better communication performance), coupling between antenna near-filed and lossy human tissue (to be minimized to reduce effects on communication), susceptibility to ambient RF interference (to be minimized by reconfiguring antenna for best signal-to-noise plus interference ratio), antenna diversity/mode-switching among one antenna with multiple elements, or between one of multiple antennas, and polarization of the antenna (which may include polarization to minimize absorption by human tissue).

In various embodiments, switching circuit 112 includes one or more low-power switches, such as one or more MEMS switches, that are used to alter such one or more characteristics of antenna system 104, which includes multiple antennas and/or multiple antenna elements. In various embodiments, the one or more MEMS switches can each be a latching type switch that consumes energy during the switching time only and uses no power or very little power once being activated in a particular position.

In various embodiments, switching circuit 112 adjusts the antenna configuration of antenna system 104 to the approximately optimal antenna configuration by adjusting a radiation pattern, a location, and/or a polarization of antenna system 104. In various embodiments, various factors affecting the performance of antenna system 104 are identified and adjusted to approximately optimize the performance of antenna system 104. Examples of such factors include configuration of the antenna system, location of the antenna system in the hearing instrument (e.g., farther from, closer to, or on the human head), orientation of near-fields of the antenna system, polarization of the antenna system relative to the wearer's head, and polarization of the antenna system relative to RF signals and noise in the environment in which the hearing assistance device is used.

In various embodiments, the one or more low-power switches of switching circuit 112 are used to select one or more antennas of antenna system 104 and/or to select one or more elements of an antenna in antenna system 104 for purposes such as changing or optimizing direction of the radiation pattern of the antenna system, changing or optimizing polarization of the antenna system, and changing or optimizing diversity reception of the antenna system to mitigate multipath fading and take advantage of fading or cross-polarization to reduce the level of ambient interference by effectively null-steering to minimize interference.

In some embodiments, performance of antenna system 104 can be optimized based on known types of devices 114 with which hearing assistance device 102 wirelessly communicates (both initiating communications, and in-session communications) and very likely, known orientations and proximity to the wearer's body. Using known use case information can allow antenna system 104 to be optimized when communicating to a known target device, or multiple known target devices. In some embodiments, an initial optimization of antenna system 104 can be performed based on known use case information, and then further optimization can be performed on a dynamic basis throughout the wireless communications session. This dynamic optimization of the antenna system can be based on optimization of parameters indicative of quality of the wireless communication, such as receiver receive signal strength (RSSI), packet error rate (PER), or other link quality assessment (LQA) parameters.

In various embodiments, the target device is a type of device in a substantially fixed location relative to hearing assistance device 102 when the hearing assistance device is worn by a wearer. Antenna optimizer 118 selects a predetermined antenna configuration from one or more predetermined antenna configurations. The one or more predetermined antenna configurations are each associated with a known location of the target device. The location of the target device may be known by the type of the target device. For example, hearing assistance device 102 and the target device can each be a hearing aid of a pair of hearing aids configured to be worn in or on one of the wearer's ears (where the wireless communication may be referred to ear-to-ear communication). In another example, the target device can be a body worn accessory device configured to be worn on a particular location on the wearer, who is instructed to wear the target device at that particular location.

In various other embodiments, the target device is a type of device in an unknown or changing location relative to hearing assistance device 102 when the hearing assistance device is worn by the wearer. Antenna optimizer 118 detects a current location of the target device and determines the approximately optimal antenna configuration according to the current location. For example, the target device can be a hand-held device such as a smartphone configured to communicate with hearing assistance device 102 and to be used as an accessory device, a remote control device, and/or a programmer. In another example, the target device can be a device that is non-portable or not intended to be worn or carried by the wearer, such as an audio streaming device or a programmer that is not intended to be carried by the wearer. An example for detecting the location of the target device is discussed in U.S. Pat. No. 9,124,983, "METHOD AND APPARATUS FOR LOCALIZATION OF STREAMING SOURCES IN HEARING ASSISTANCE SYSTEM", assigned to Starkey Laboratories, Inc., which is incorporated herein by reference in its entirety.

Figure 2:
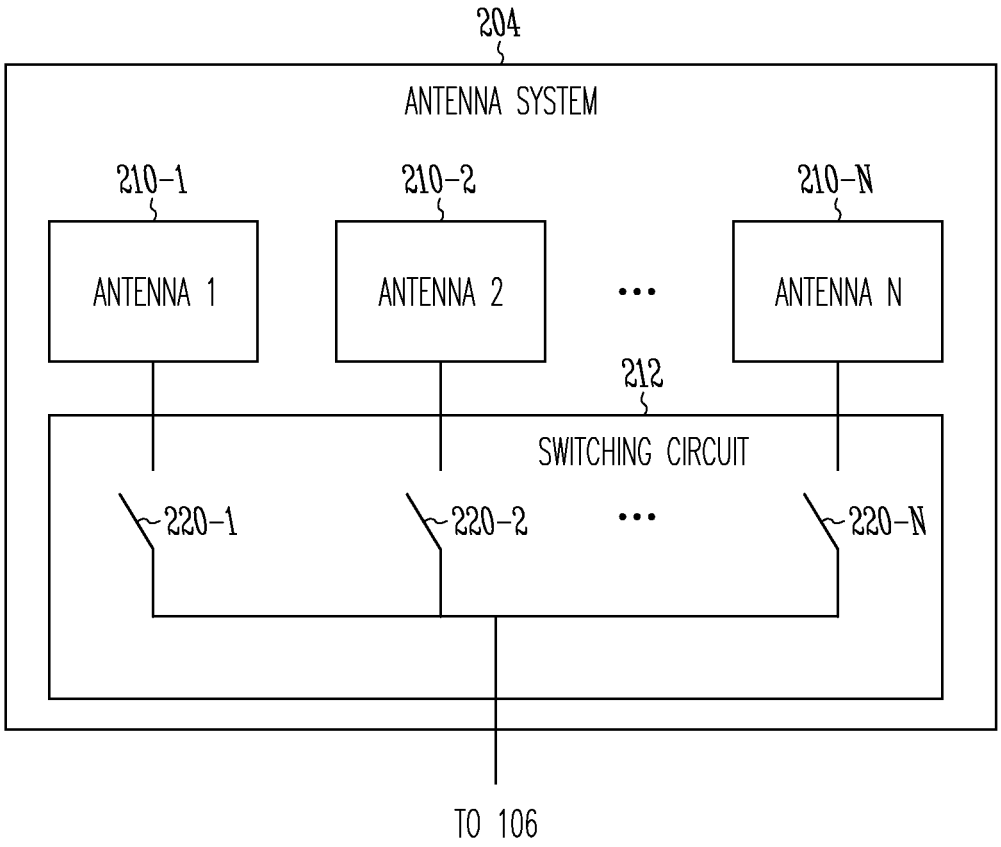
FIG. 2 is a block diagram illustrating an embodiment of an antenna system of the hearing assistance device.

FIG. 2 is a block diagram illustrating an embodiment of an antenna system 204, which represents an embodiment of antenna system 104. Antenna system 204 includes a plurality of antennas 210 and a switching circuit 212. Antenna 210 each include one or more antenna elements. Switching circuit 212 includes one or more switches between antennas 210 and communication circuit 106. In the illustrated embodiment, switching circuit 212 includes switch 220-1 connected between antenna 210-1 and communication circuit 106, switch 220-2 connected between antenna 210-2 and communication circuit 106, . . . and switch 220-N connected between antenna 210-N and communication circuit 106. In other embodiments, antennas 210 can include two or more antennas, and switching circuit 212 can include one or more switches (not necessary matching the number of antennas). For example, one or more antennas of antenna 210 can be always connected to communication circuit 106, while the other one or more antennas of antenna 210 can each be switched in or out according to the approximately optimal antenna configuration.

In various embodiments, antennas 210 include two or more antennas of the same type and/or two or more antennas of different types. In various embodiments, antennas 210 include two or more antennas having substantially identical physical configurations and/or two or more antennas having substantially different physical configurations. In various embodiments, antennas 210 include two or more antennas having substantially identical physical configurations but substantially different orientations when arranged in the hearing assistance device. In various embodiments, antennas 210 include two or more antennas having substantially identical physical configurations and substantially identical orientations when arranged in the hearing assistance device.

Figure 3:
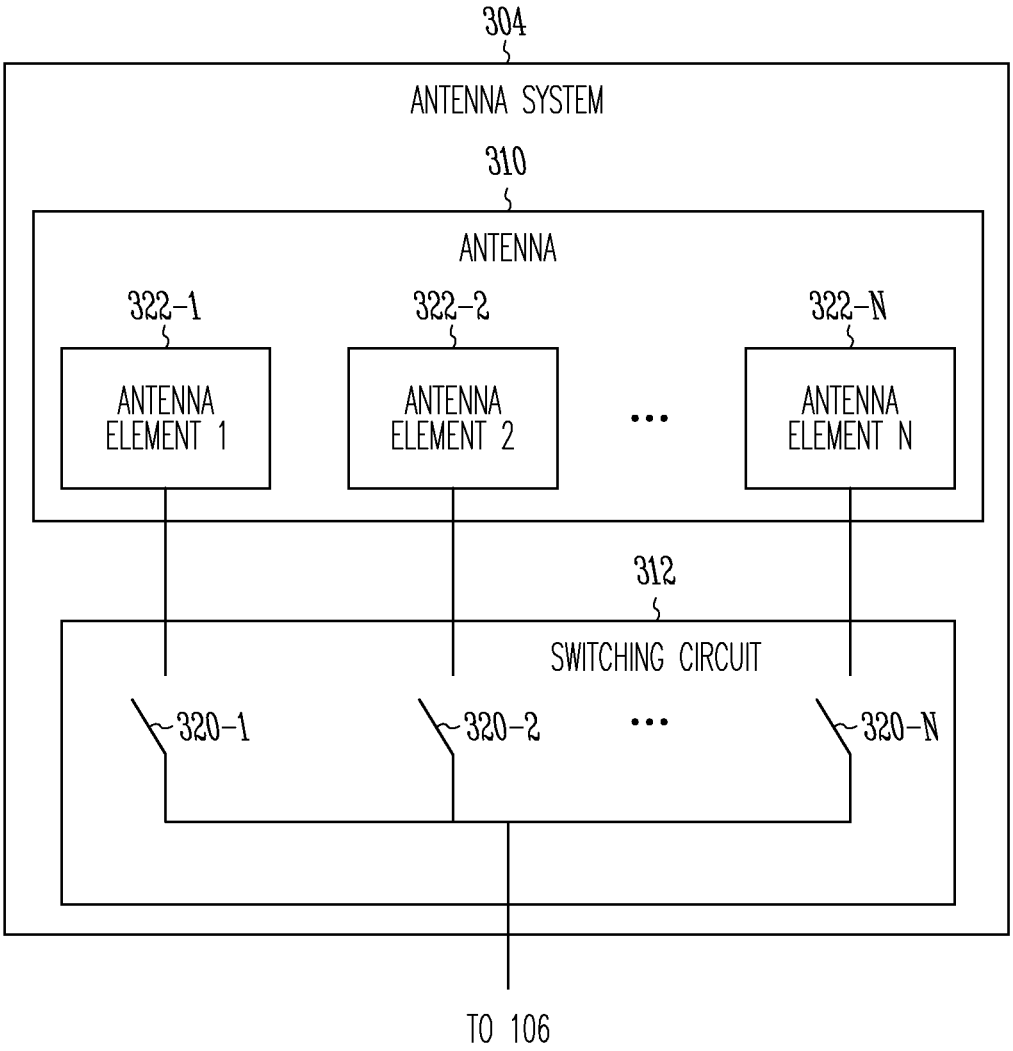
FIG. 3 is a block diagram illustrating another embodiment of the antenna system.

FIG. 3 is a block diagram illustrating an embodiment of an antenna system 304, which represents another embodiment of antenna system 104. Antenna system 304 includes an antennas 310 and a switching circuit 312. Antenna 310 includes a plurality of antenna elements 322. Switching circuit 312 includes one or more switches between antenna 310 and communication circuit 106. In the illustrated embodiment, switching circuit 312 includes switch 320-1 connected between antenna element 322-1 and communication circuit 106, switch 320-2 connected between antenna element 322-2 and communication circuit 106, . . . and switch 320-N connected between antenna element 310-N and communication circuit 106. In other embodiments, antenna 310 can include two or more antenna elements, and switching circuit 312 can include one or more switches (not necessary matching the number of antennas). For example, one or more antenna elements of antenna 310 can be always connected to communication circuit 106, while the other one or more antenna elements of antenna 310 can each be switched in or out according to the approximately optimal antenna configuration.

In various embodiments, antenna elements 322 include two or more elements having substantially identical physical configurations and/or two or more elements having substantially different physical configurations. In various embodiments, antenna elements 322 include two or more elements having substantially identical physical configurations but substantially different orientations when arranged in the hearing assistance device. In various embodiments, antenna elements 322 include two or more elements having substantially identical physical configurations and substantially identical orientations when arranged in the hearing assistance device.

Figure 4:
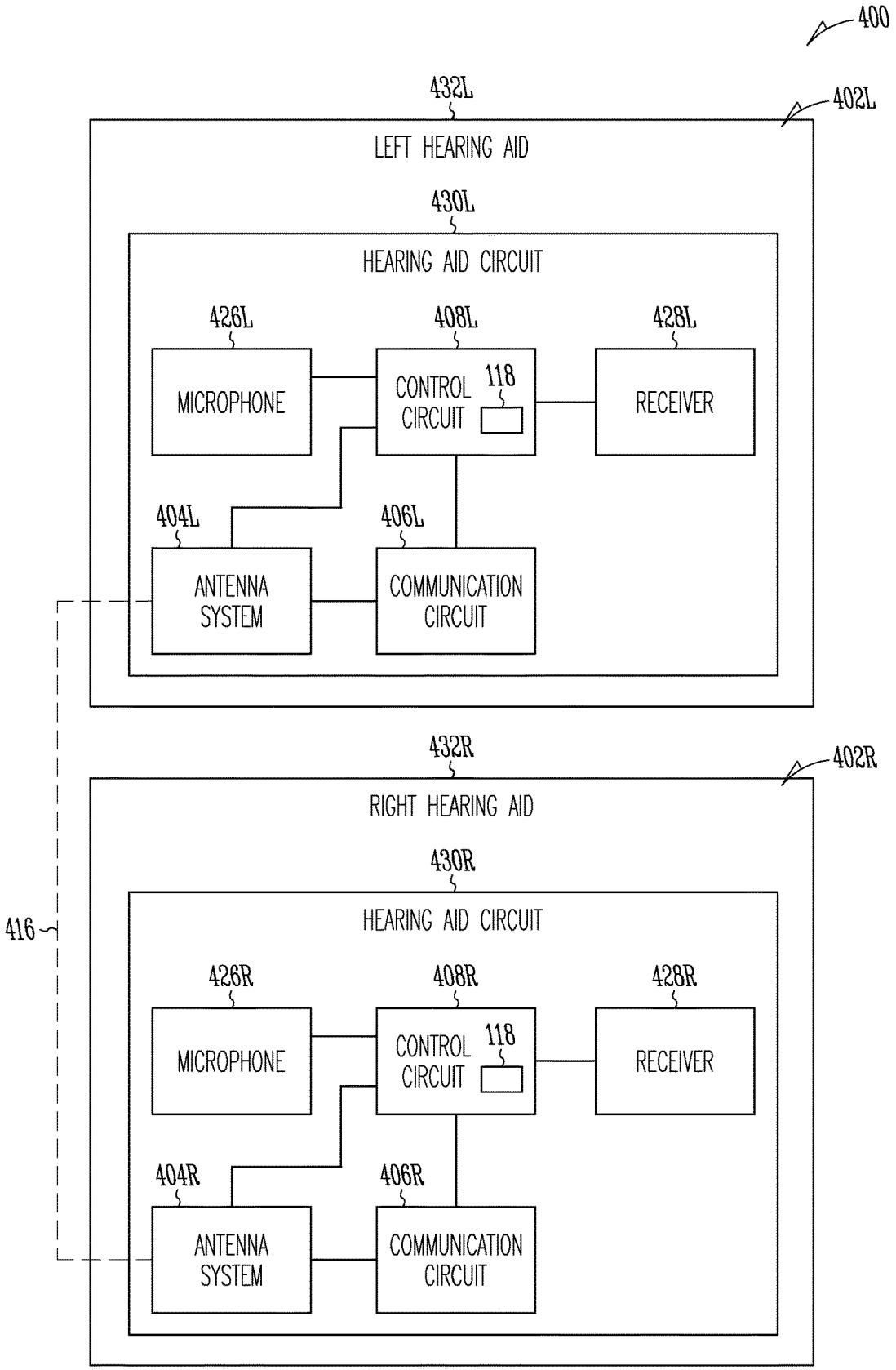
FIG. 4 is a block diagram illustrating an embodiment of a hearing assistance system.

The techniques of adjusting the antenna configuration using one or more switches as discussed with references to FIGS. 3 and 4 can be combined. For example, antenna system 104 can include a plurality of antennas, and at least one antenna of the plurality of antenna can include a plurality of antenna elements. The antenna configuration can be controlled by switching in or out each antenna as well as each antenna elements. The embodiments as illustrated in FIGS. 3 and 4 are examples rather than limitations. For example, the antenna configuration can also be controlled using one or more switches connected between antennas and/or antenna elements.

FIG. 4 is a block diagram illustrating an embodiment of a hearing assistance system 400, which represents an embodiment of system 100 with a pair of hearing aids performing ear-to-ear wireless communication. System 400 includes a left hearing aid 402L and a right hearing aid 402R communicatively coupled to each other via a wireless binaural link 416 to perform ear-to-ear wireless communication.

Left hearing aid 402L represents an embodiment of hearing assistance device 102 (with right hearing aid 402R representing an embodiment of the target device) or an embodiment of the target device (with right hearing aid 402R representing an embodiment of hearing assistance device 102). Left hearing aid 402L is configured to be worn in or about the left ear of the wearer and includes a hearing aid circuit 430L and a shell 432L that houses hearing aid circuit 430L. Examples of shell 432L include, but are not limited to, housing for a BTE, ITE, ITC, RIC, CIC, or RITE type hearing aid for use with the left ear. Hearing aid circuit 430L includes a microphone 426L, an antenna system 404L, a communication circuit 406L, a control circuit 408L, and a receiver (speaker) 428L. Microphone 426L receives sounds from the environment of the wearer and produces a left microphone signal representing the received sounds. Communication circuit 406L performs wireless communication including ear-to-ear communication with right hearing aid 402R via binaural link 416. Control circuit 408L processes the left microphone signal and/or a signal received by communication circuit 406L to produce a left sound. Receiver 428L transmits the left sound to the left ear of the hearing aid user.

Right hearing aid 402R represents an embodiment of the target device (with left hearing aid representing an embodiment of hearing assistance device 102) or an embodiment of hearing assistance device 102 (with left hearing aid representing an embodiment of the target device). Right hearing aid 402R is configured to be worn in or about the right ear of the wearer and includes a hearing aid circuit 430R and a shell 432R that houses hearing aid circuit 430R. Examples of shell 432R include, but are not limited to, housing for a BTE, ITE, ITC, RIC, CIC, or RITE type hearing aid for use with the right ear. Hearing aid circuit 430R includes a microphone 426R, an antenna system 404R, a communication circuit 406R, a control circuit 408R, and a receiver (speaker) 428R. Microphone 426R receives sounds from the environment of the wearer and produces a right microphone signal representing the received sounds. Communication circuit 406R performs wireless communication including ear-to-ear communication with left hearing aid 402L via binaural link 416. Control circuit 408R processes the right microphone signal and/or a signal received by communication circuit 406R to produce a right sound. Receiver 428L transmits the right sound to the left ear of the hearing aid user.

Examples for each of antenna systems 404L and 404R include antenna systems 104, 204, and 304. An example for each of communication circuits 406L and 406R includes communication circuit 106. An example for each of control circuits 408L and 408R includes control circuit 108. In the illustrated embodiment, control circuits 408L and 408R each including antenna optimizer 118 for optimization the antenna configuration of antenna systems 404L and 404R, respectively.

Figure 5:
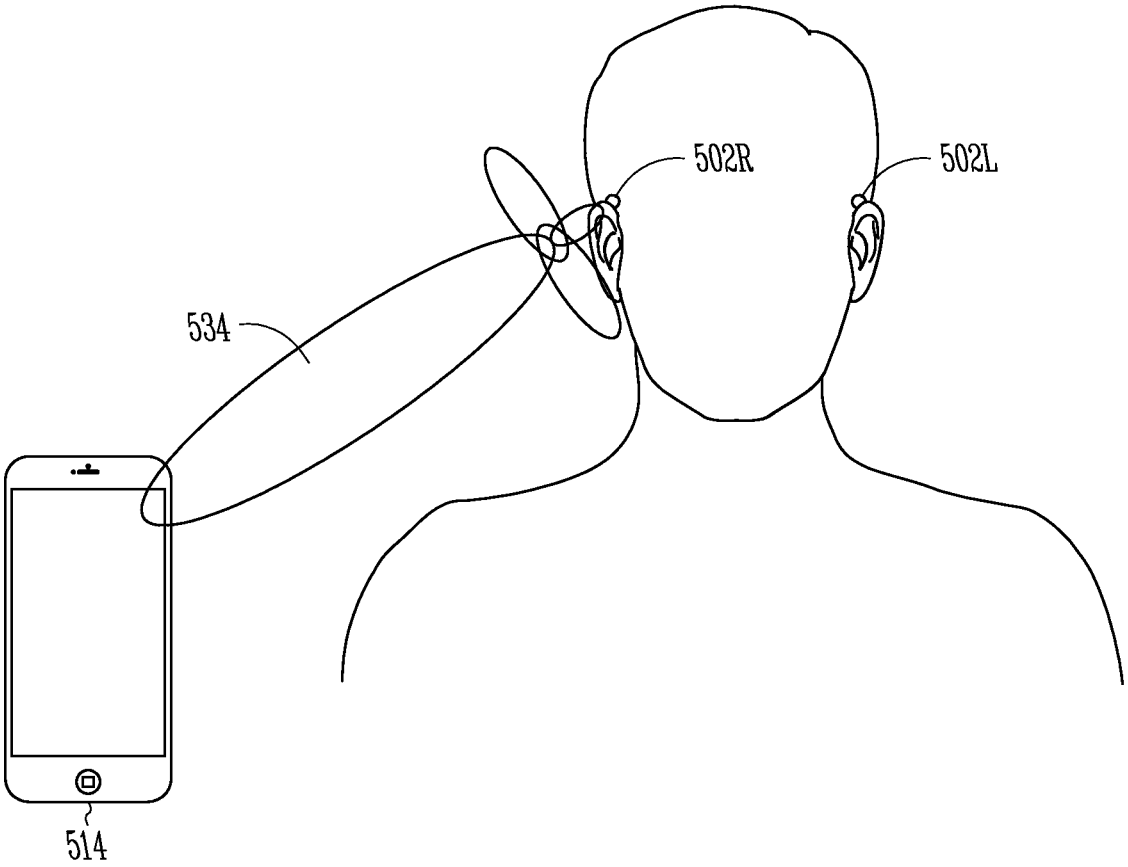
FIG. 5 is an illustration of an embodiment of a radiation pattern of the antenna system adjusted for communicating with a hand-held device.

FIG. 5 is an illustration of an embodiment of a radiation pattern of the antenna system adjusted for communicating with a hand-held device. A pair of left hearing aid 502L and right hearing aid 502R are worn on or about the left and right ears of the wearer, respectively. Right hearing aid 502R is communicating with a hand-held device 514 (shown as a smartphone for illustrative, and not restrictive, purposes). An example of the pair of left hearing aid 502L and right hearing aid 502R includes the pair of left hearing aid 402L and right hearing aid 402R as discussed in this document. An example of hand-held device 514 include the target device, as discussed in this document, which is selected from device 114 and configured to be hand-held. The radiation pattern of the antenna system of right hearing aid 502R is adjusted to a radiation pattern 532 according to an approximately optimal antenna configuration determined by right hearing aid 502R. Radiation pattern 532 provides for a directionality of the antenna system that is approximately optimized for the location of hand-held device relative to hearing aid 502R.

Figure 6:
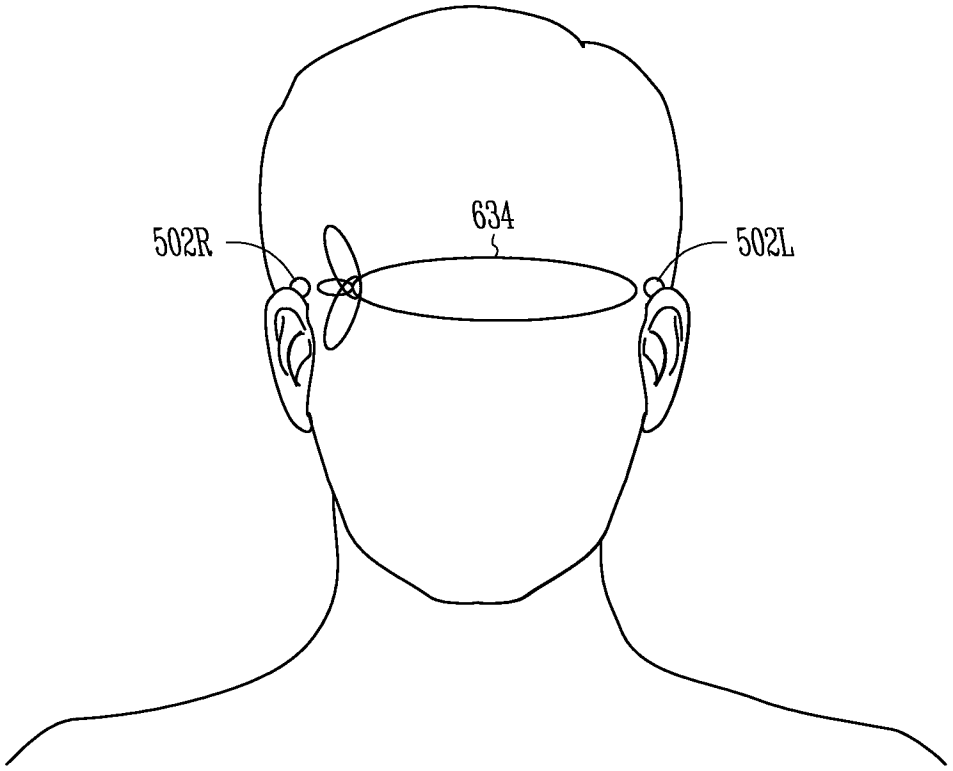
FIG. 6 is an illustration of an embodiment of a radiation pattern of the antenna system adjusted for ear-to-ear communication.

FIG. 6 is an illustration of an embodiment of a radiation pattern of the antenna system adjusted for ear-to-ear communication between left hearing aid 502L and right hearing aid 502R. Right hearing aid 502R communicates with left hearing aid 502L, which functions as the target device as discussed in this document. The radiation pattern of the antenna system of right hearing aid 502R is adjusted to a radiation pattern 634 according to an approximately optimal antenna configuration determined by right hearing aid 502R for ear-to-ear communication with hearing aid 502L. Radiation pattern 634 provides for a directionality of the antenna system that is approximately optimized for right haring aid 502R to communicate with left hearing aid 502L.

Right hearing aid 502R is illustrated in FIGS. 5 and 6 with the radiation pattern of its antenna system, and illustrated in FIG. 5 as being communicatively coupled to the hand-held device, by way of example and not by way of imitation. In various embodiments, the antenna system of either or both of left hearing aid 502L and right hearing aid 502R can have the adjustable antenna configuration that is adjusted to the approximately optimal antenna configuration according to the present subject matter. In various embodiments, either or both of left hearing aid 502L and right hearing aid 502R can be configured to communicate with another device and have the adjustable antenna configuration adjusted to the approximately optimal antenna configuration for the location of that other device according to the present subject matter.

Figure 7:
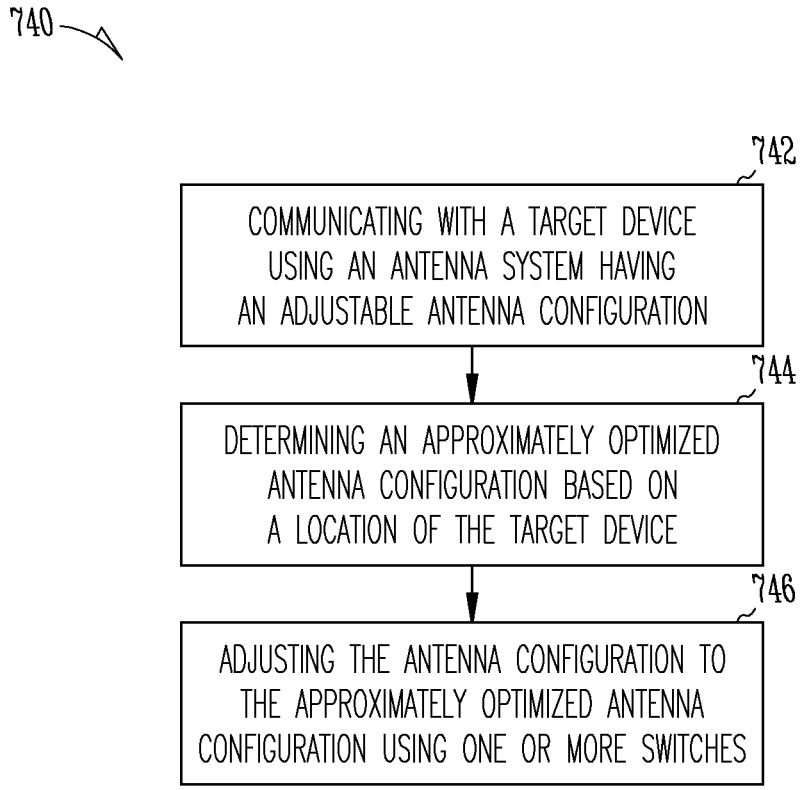
FIG. 7 is a flow chart illustrating an embodiment of a method for operating a hearing assistance device for wireless communication with another device.

FIG. 7 is a flow chart illustrating an embodiment of a method 740 for operating a hearing assistance device for wireless communication with another device. In one embodiment, method 700 is performed by a hearing assistance device such as hearing assistance device 102, including its various embodiments, as discussed in this document, wirelessly to communicate with a target device such as one of devices 114 as discussed in this document.

At 742, the hearing assistance device communicates with the target device using an antenna system having an adjustable antenna configuration. In various embodiments, the antenna system includes one or more antennas each including one or more antenna elements, and the antenna configuration can be adjusted using one or more switches controlling which antenna(s) and/or antenna element(s) are activated (i.e., electrically connected to a communication circuit of the hearing assistance device that transmits and receives signals using the antenna system.

At 744, an approximately optimal antenna configuration is determined for communicating with the target device based on a location of the target device relative to the hearing assistance device. The approximately optimal antenna configuration provides the hearing assistance device with an approximately optimal performance of the wireless communication with communicating with the target device that is at that location. In various embodiments, the approximately optimal antenna configuration is determined by selecting a predetermined antenna configuration from one or more predetermined antenna configurations each associated with a known location of the target device. For example, the hearing assistance device and the target device are each a hearing aid of a pair of hearing aids configured to be worn by a hearing aid wearer, and the wireless communication between the hearing assistance device and the target device is ear-to-ear communication between the hearing aids. Other examples include the target device having a substantially unchanged location relative to the hearing assistance device, such that when the wearer is instructed to wear or hold the target device at a specific location. In various other embodiments, approximately optimal antenna configuration is determined by detecting a current location of the target device and determining the approximately optimal antenna configuration based on the current location. For example, the target device can be a hand-held or body-worn device whose location relative to the hearing assistance device may change substantially from time to time when the hearing assistance device is used, or a device that is not intended to be carried by or otherwise move with the wearer.

At 746, the antenna configuration of the antenna system is adjusted to the approximately optimal antenna configuration by controlling one or more switches each connected between the antenna system and a communication circuit of the hearing assistance system. In various embodiments, the antenna configurations are adjusted to change a radiation pattern of the antenna system, an effective location of the antenna system relative to the hearing assistance device, and/or a polarization of the antenna system. In one embodiment, the antenna system includes an antenna including a plurality of antenna elements. The hearing assistance device transmits and receives signals using one or more elements of the plurality of antenna elements. The one or more switches are used to control one or more electrical connections between the plurality of antenna elements and the communication circuit. In another embodiment, the antenna system includes a plurality of antennas. The hearing assistance device transmits and receives signals using one or more antennas of the plurality of antennas. The one or more switches are used to control one or more electrical connections between the plurality of antennas and the communication circuit.

Hearing assistance devices typically include at least one enclosure or housing, a microphone, hearing assistance device electronics including processing electronics, and a speaker or "receiver." Hearing assistance devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

Various embodiments of the present subject matter support wireless communications with a hearing assistance device. In various embodiments the wireless communications can include standard or nonstandard communications. Some examples of standard wireless communications include, but are not limited to, Bluetooth™, low energy Bluetooth, IEEE 802.11 (wireless LANs), 802.15 (WPANs), and 802.16 (WiMAX). Cellular communications may include, but not limited to, CDMA, GSM, ZigBee, and ultra-wideband (UWB) technologies. In various embodiments, the communications are radio frequency communications. In various embodiments the communications are optical communications, such as infrared communications. In various embodiments, the communications are inductive communications. In various embodiments, the communications are ultrasound communications. Although embodiments of the present system may be demonstrated as radio communication systems, it is possible that other forms of wireless communications can be used. It is understood that past and present standards can be used. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new protocols may be employed without departing from the scope of the present subject matter.

In various embodiments, the present subject matter is used in hearing assistance devices that are configured to communicate with mobile phones. In such embodiments, the hearing assistance device may be operable to perform one or more of the following: answer incoming calls, hang up on calls, and/or provide two way telephone communications. In various embodiments, the present subject matter is used in hearing assistance devices configured to communicate with packet-based devices. In various embodiments, the present subject matter includes hearing assistance devices configured to communicate with streaming audio devices. In various embodiments, the present subject matter includes hearing assistance devices configured to communicate with Wi-Fi devices. In various embodiments, the present subject matter includes hearing assistance devices capable of being controlled by remote control devices.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing assistance devices, such as hearing aids, headsets, headphones, and similar hearing devices.

The present subject matter may be employed in hearing assistance devices having additional sensors. Such sensors include, but are not limited to, magnetic field sensors, telecoils, temperature sensors, accelerometers and proximity sensors.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices. The present subject matter can also be used in deep insertion devices having a transducer, such as a receiver or microphone. The present subject matter can be used in devices whether such devices are standard or custom fit and whether they provide an open or an occlusive design. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device for being worn by a wearer and capable of wireless communication with a plurality of devices including a target device, the hearing assistance device comprising:

a communication circuit configured to transmit signals to and receive signals from each device of the plurality of devices;

an antenna system coupled to the communication circuit and having an antenna configuration adjustable for controlling a radiation pattern providing for a directionality of the antenna system, the antenna system including:

one or more antennas; and a switching circuit configured to control one or more electrical connections between the one or more antennas and the communication circuit, the one or more electrical connections controlling the antenna configuration; and a control circuit including an antenna optimizer coupled to the switching circuit, the antenna optimizer configured to determine an approximately optimal antenna configuration based on a location of the target device relative to the hearing assistance device and to control the switching circuit according to the approximately optimal antenna configuration such that the directionality of the antenna system is approximately optimized for communicating with the target device when the target device is at the location.

2. The hearing assistance device of claim 1, wherein the switching circuit comprises one or more micro-electro-mechanical systems (MEMS) switches.

3. The hearing assistance device of claim 2, wherein the one or more antennas comprise an antenna including a plurality of antenna elements, and the one or more MEMS switches are connected between the plurality of antenna elements and the communication circuit.

4. The hearing assistance device of claim 2, wherein the one or more antennas comprise a plurality of antennas, and the one or more MEMS switches are connected between the plurality of antennas and the communication circuit.

5. The hearing assistance device of claim 1, wherein the antenna optimizer is configured to select the approximately optimal antenna configuration from one or more predetermined antenna configurations based on the location of the target device relative to the hearing assistance device as indicated by a type of the target device.

6. The hearing assistance device of claim 5, wherein the antenna optimizer is configured to select the approximately optimal antenna configuration from one or more predetermined antenna configurations each designated for a known location of the target device relative to the hearing assistance device when the hearing assistance device is worn by the wearer.

7. The heating assistance device of claim 6, wherein the antenna optimizer is configured to select a predetermined antenna configurations designated for another hearing assistance device configured to be coupled to the hearing assistance device via a wireless binaural link.

8. The heating assistance device of claim 1, wherein the antenna optimizer is configured to detect a current location of the target device when the location of the target device relative to the hearing assistance device is not known and determine the approximately optimal antenna configuration based on the current location.

9. A hearing assistance system, comprising:

a target device; and a hearing assistance device including:

a communication circuit configured to wirelessly communicate with the target device;

an antenna system coupled to the communication circuit and including one or more antennas and a switching circuit, the antenna system having an antenna configuration adjustable for controlling a radiation pattern providing for a directionality of the antenna system, the switching circuit configured to adjust the antenna configuration by controlling one or more electrical connections between the one or more antennas and the communication circuit; and a control circuit including an antenna optimizer coupled to the switching circuit, the antenna optimizer configured to determine an approximately optimal antenna configuration based on a location of the target device when the location of the target device relative to the hearing assistance device is indicated by a type of the target device and to control the switching circuit according to the approximately optimal antenna configuration such that the directionality of the antenna system is approximately optimized for communicating with the target device when the target device is at the location.

10. The system of claim 9, wherein the switching circuit comprises one or more micro-electro-mechanical systems (MEMS) switches and is configured to control the one or more electrical connections using the one or more MEMS switches.

11. The system of claim 9, wherein the antenna optimizer is configured to select the approximately optimal antenna configuration from one or more predetermined antenna configurations each designated for a known location of the target device relative to the hearing assistance device when the hearing assistance device is worn by the wearer.

12. The system of claim 11, comprising a pair of first and second hearing aids configured to perform ear-to-ear communication with each other, and wherein the hearing assistance device is the first hearing aid, and the target device is the second hearing aid.

13. The system of claim 11, wherein the hearing assistance device is a hearing aid, and the target device is a hearing aid accessory device configured to be worn by the wearer at a specified location on the wearer.

14. The system of claim 9 wherein the antenna optimizer is configured to detect a current location of the target device when the location of the target device relative to the hearing assistance device is not indicated by the type of the target device and determine the approximately optimal antenna configuration based on the current location.

15. The system of claim 14, wherein the hearing assistance device comprises a hearing aid, and the target device comprises a hand-held device.

16. The system of claim 14, wherein the hearing assistance device comprises a hearing aid, and the target device comprises a non-portable device.

17. A method for operating a hearing assistance device for wireless communication, comprising:

communicating with a target device using an antenna system of the hearing assistance device, the antenna system having an antenna configuration that is adjustable for controlling a radiation pattern providing for a directionality of the antenna system;

determining an approximately optimal antenna configuration based on a location of the target device relative to the hearing assistance device, such that the directionality of the antenna system is approximately optimized for communicating with the target device when the target device is at the location:

adjusting the directionality of the antenna system by setting the antenna configuration of the antenna system to the approximately optimal antenna configuration, the adjusting including controlling one or more switches each connected between the antenna system and a communication circuit of the hearing assistance device, the one or more switches controlling the antenna configuration.

18. The method of claim 17, wherein the adjusting the antenna configuration comprises adjusting the antenna configuration to change one or more of a radiation pattern of the antenna system, an effective location of the antenna system relative to the hearing assistance device, and a polarization of the antenna system.

19. The method of claim 18, wherein the antenna system comprises an antenna including a plurality of antenna elements, transmitting and receiving signals using the antenna system comprises transmitting and receiving signals using one or more elements of the plurality of antenna elements, and controlling the one or more switches comprises controlling one or more switches connected between the plurality of antenna elements and the communication circuit.

20. The method of claim 18, wherein the antenna system comprises a plurality of antennas, transmitting and receiving signals using the antenna system comprises transmitting and receiving signals using one or more antennas of the plurality of antennas, and controlling the one or more switches comprises controlling one or more switches connected between the plurality of antennas and the communication circuit.

21. The method of claim 17, wherein determining the approximately optimal antenna configuration comprises selecting a predetermined antenna configuration from one or more predetermined antenna configurations each associated with a known location of the target device.

22. The method of claim 21, wherein the hearing assistance device and the target device are each a hearing aid of a pair of hearing aids configured to be worn by a hearing aid wearer, and communicating with the target device comprises performing ear-to-ear communication between the hearing aids.

23. The method of claim 17, wherein determining the approximately optimal antenna configuration comprises:

detecting a current location of the target device when the location of the target device relative to the hearing assistance device is not indicated by the type of the target device; and determining the approximately optimal antenna configuration based on the current location.

* * * * *